United States Patent [19]

Roth

[11] 4,221,940

[45] Sep. 9, 1980

[54] SENSOR

[75] Inventor: Norman J. Roth, Kokomo, Ind.

[73] Assignee: General Motors Corporation, Detroit, Mich.

[21] Appl. No.: 2,946

[22] Filed: Jan. 12, 1979

[51] Int. Cl.[2] ..... H01H 35/14

[52] U.S. Cl. ..... 200/61.45 R; 200/61.48; 200/61.51

[58] Field of Search ..... 200/61.45 R, 61.45 M, 200/61.48, 61.49, 61.51, 61.52, 61.53

[56] References Cited

U.S. PATENT DOCUMENTS

| | | | |
|---|---|---|---|
| 3,552,768 | 1/1971 | Kaiser | 200/61.45 R X |
| 3,618,117 | 11/1971 | Kaiser | 200/61.45 R X |
| 3,678,763 | 7/1972 | Brooks et al. | 200/61.45 M X |
| 3,710,051 | 1/1973 | Orlando | 200/61.45 R |
| 3,717,731 | 2/1973 | Porter et al. | 200/61.45 M |
| 3,717,732 | 2/1973 | Porter | 200/61.45 M |
| 3,749,863 | 7/1973 | Kaiser | 200/61.48 X |
| 3,832,507 | 8/1974 | Marquardt et al. | 200/61.48 X |
| 3,944,764 | 3/1976 | Hirashima et al. | 200/61.48 X |

FOREIGN PATENT DOCUMENTS

| | | | |
|---|---|---|---|
| 126192 | 1/1932 | Fed. Rep. of Germany | 200/61.48 |

*Primary Examiner*—James R. Scott
*Attorney, Agent, or Firm*—Herbert Furman

[57] ABSTRACT

An acceleration responsive sensor having a housing of molded dielectric material provided with an elongated sector shaped recess receiving a pendulum supported mass movable under an acceleration pulse into engagement with one or more fingers of a contact assembly within the recess. The mass and the contact assembly are mounted to the housing exteriorly of the recess and covered by a cover assembly of molded dielectric material.

6 Claims, 10 Drawing Figures

SENSOR

FIELD OF INVENTION

This invention relates generally to acceleration responsive sensors and more particularly to pendulum type acceleration responsive sensors.

BACKGROUND OF THE INVENTION

Pendulum type sensors of the general type disclosed herein are shown in the prior art United States patents to Porter et al U.S. Pat. No. 3,717,731 issued Feb. 20, 1973; Porter U.S. Pat. No. 3,717,732 issued Feb. 20, 1973; Brooks et al U.S. Pat. No. 3,678,763 issued July 23, 1972; and Orlando U.S. Pat. No. 3,710,051 issued Jan. 9, 1973. Generally such sensors include an acceleration responsive mass which is suspended by a deflectable wire within a sector shaped recess. Either a magnet or the deflection of the wire or both provides a preload bias on the mass normally locating the mass in unactuated position in engagement with the angular side walls of the recess adjacent the proximal ends thereof. Electrical contacts located adjacent the distal end of the recess are engaged by the mass to close an electrical circuit when the mass is subjected to a pulse of predetermined amplitude and time sufficient to overcome the preload bias and move the mass through the recess and into engagement with the contacts.

SUMMARY OF THE INVENTION

The sensor of this invention differs from such prior art sensors in several respects. One feature of this invention is that the housing of the sensor is of molded dielectric material having an elongated sector shaped recess, one end of which is closed by an integral end wall and the other open end of which is surrounded by an integral lateral flange which provides the mountings for the mass assembly, the contact assembly, and a monitor contact assembly if one is provided. Another feature is that the contact assembly extends longitudinally of the recess and includes a plurality of contact fingers which engage a fixed stop on the end wall of the recess and are deflected thereby from normal position in order to locate the contact fingers in a predetermined deflected position relative to the proximal wall of the recess. A further feature is that the contact assembly is cantilevered within the recess by lateral flanges which overlie the lateral flange of the housing and are secured thereto by integral means on such flange which both locate the contact flanges and integrally secure such flanges to the housing flange. Yet another feature is that a contact plate of thicker material than the flanges of the contact assembly overlie such flanges in order to prevent axial shifting movement of the contact assembly within the recess and possible disengagement of the contact fingers from the fixed stop on the end wall of the recess. Yet a further feature is that the mass is supported within the recess by a hanger assembly which includes a hanger plate overlying an integrally secured to the housing flange and having extending therefrom a deflectable spring wire supporting the mass. Yet another feature is that the hanger plate includes a deflectable portion so that the deflection of the wire can be adjusted to adjust and preset the preload bias on the mass locating the mass in engagement with the side walls of the recess adjacent the proximal end thereof and in predetermined spaced relationship to the contact fingers. Still another feature is that the open end of the recess and the mountings on the lateral flange of the housing are covered by a cover assembly secured to the housing flange. Still a further feature is that a dust cover over the cover assembly both encloses and protects the terminal connections of a wiring harness to the sensor.

Generally sensors of the type disclosed herein are used redundantly in order to ensure actuation of the device to be actuated when the object on which the sensor is mounted is subjected to an acceleration pulse of predetermined amplitude and time. The drawings herein show a sensor assembly 12 having redundant sensors 14 and 16. Since both sensors are the same, only sensor 14 will be particularly described and like parts of assembly 12 and sensor 16 will be indicated by prime numerals and described only where necessary to an understanding of this disclosure.

Figure 1:
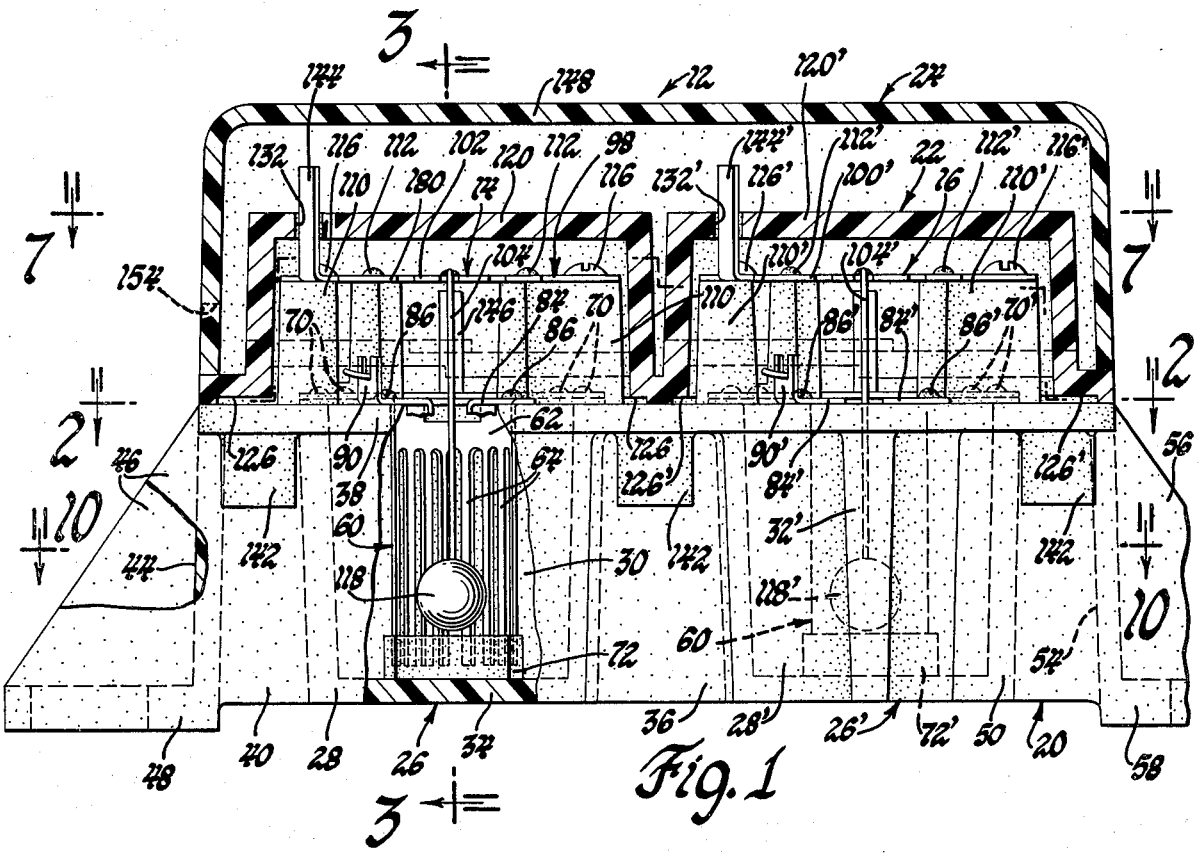
FIG. 1 is a partially broken away side elevational view of a sensor assembly embodying a sensor according to this invention.
Figure 10:
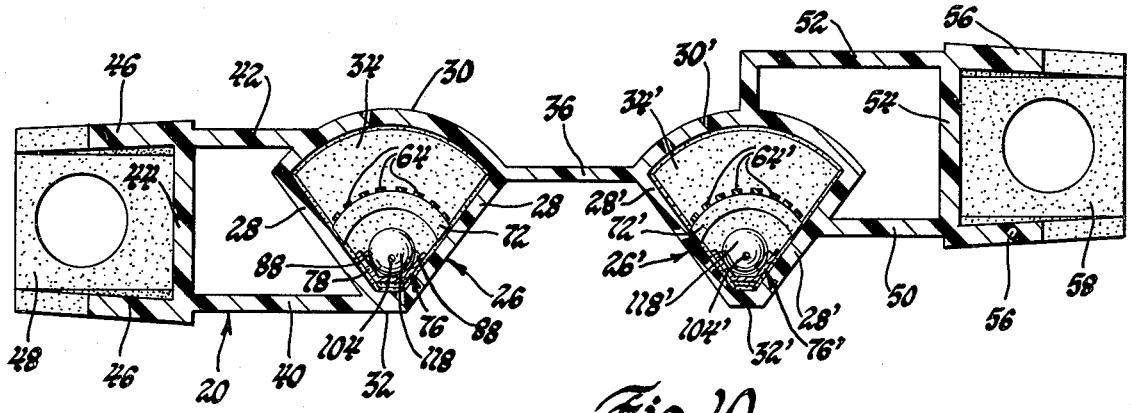
FIG. 10 is a sectional view taken generally along the plane indicated by line 10—10 of FIG. 1.

Referring now to FIGS. 1 and 10 of the drawings, the sensor assembly 12 generally includes a housing assembly 20, a cover assembly 22 and a dust cover assembly 24. These assemblies are each formed of molded dielectric material. The housing assembly 20 includes a pair of like slightly tapered elongated sector shaped recesses 26, 26', each of which includes a pair of angularly related longitudinally tapered side walls 28, 28' integrally joined by longitudinally tapered distal and proximal end walls 30, 30' and 32, 32' respectively. The proximal wall is generally planar and the distal wall is generally arcuate. The recesses are closed by integral lower end walls 34, 34' and their inner side walls are interconnected throughout their longitudinal extent by an integral web 36. An integral upper wall or flange 38 interconnects the recesses 32, 32' and surrounds the upper open ends of the recesses.

A pair of longitudinal integral walls 40 and 42 extend laterally of the recess 26, with wall 40 being formed as a continuation of the proximal wall 32 and wall 42 extending from wall 30 generally adjacent the juncture of this wall with the outer side wall 28. Walls 40 and 42 are also formed integrally with the upper flange 38. These walls are interconnected by an integral wall 44 which likewise is integral with flange 38. A pair of angular reinforcement walls 46 are formed integral with wall 44 and are interconnected by an integral lower apertured wall 48 which provides one mounting pad for the sensor.

Likewise, a pair of longitudinal integral walls 50 and 52 extend laterally from the recess 26', with wall 50 extending from the outer wall 28' generally adjacent the juncture thereof with wall 32' and wall 52 extending from the wall 30' and joined thereto by a short lateral wall. Walls 50 and 52 are likewise integral with the flange 38 and are integrally interconnected by a wall 54 which is also integral with wall 38. A pair of angular reinforcement walls 56 extend integrally from wall 54 and are interconnected by an integral lower apertured wall 58 which provides the other mounting pad for the sensor.

Figure 6:
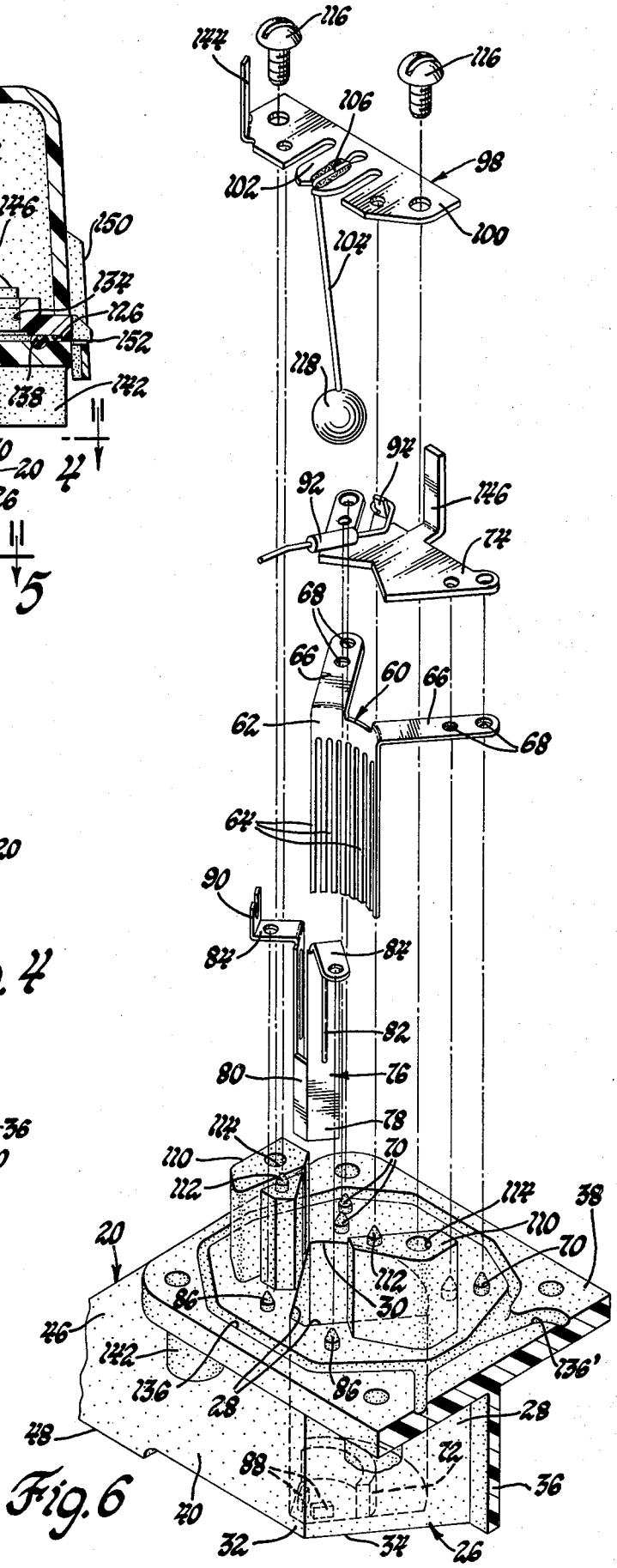
FIG. 6 is an exploded perspective view of a portion of FIG. 3.

Sensor 14 includes a contact assembly 60 shown best in FIG. 6. Assembly 60 includes an arcuate body portion 62 having extending longitudinally therefrom a plurality of contact fingers 64. A pair of lateral flanges 66 likewise extend from the body portion 62 angularly with respect to each other, with each flange being apertured in at least two places 68.

Figure 2:
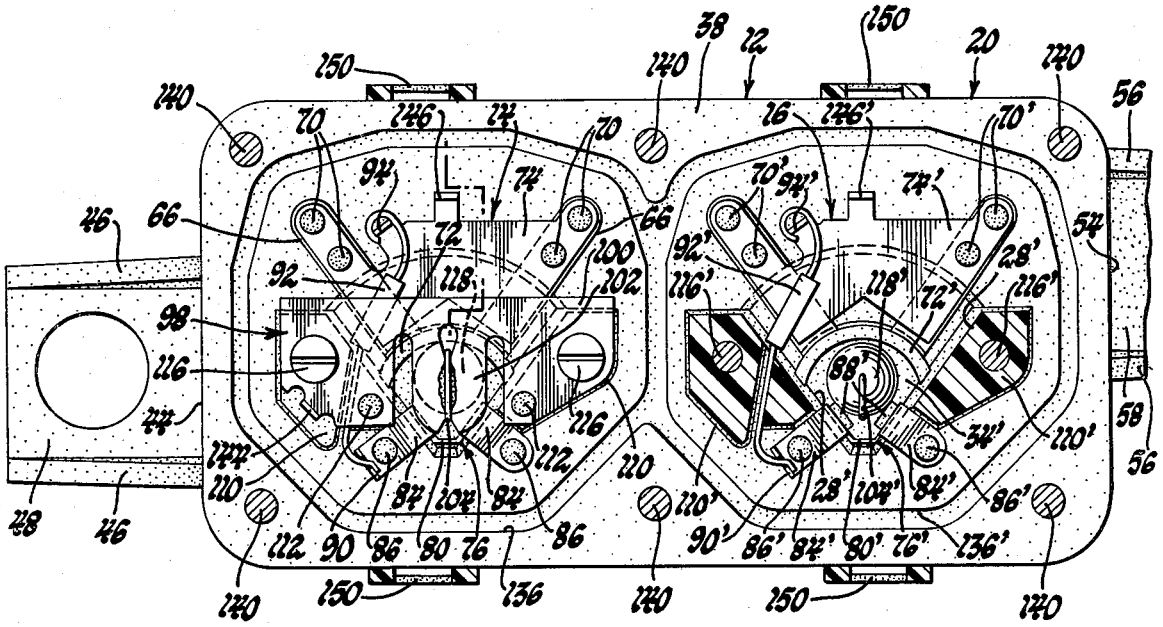
FIG. 2 is a partially broken away sectional view taken generally along the plane indicated by line 2—2 of FIG. 1.
Figure 3:
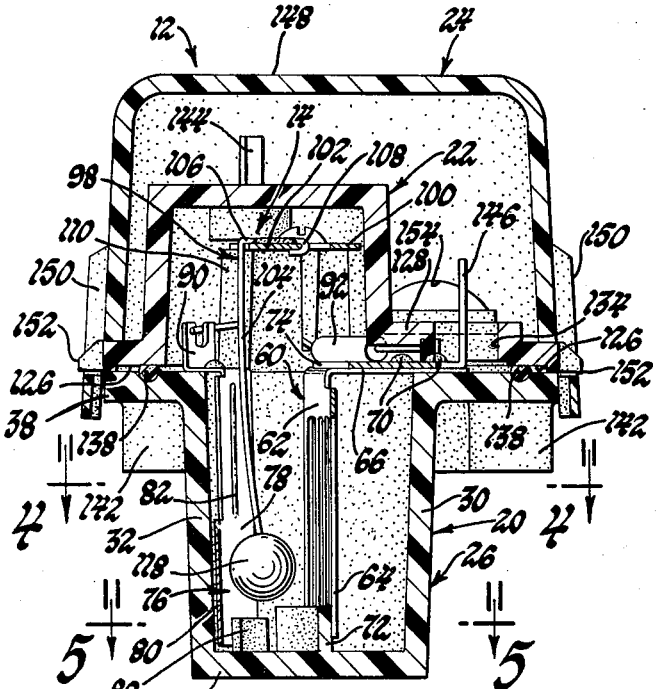
FIG. 3 is a sectional view taken generally along the plane indicated by line 3—3 of FIG. 1.
Figure 4:
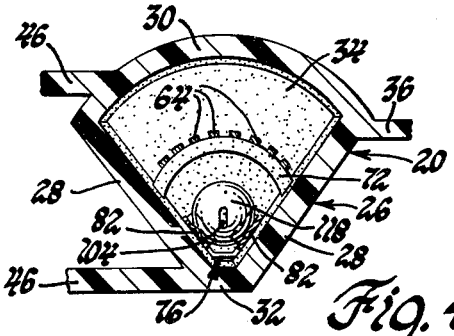
FIG. 4 is a sectional view taken generally along the plane indicated by line 4—4 of FIG. 3.
Figure 5:
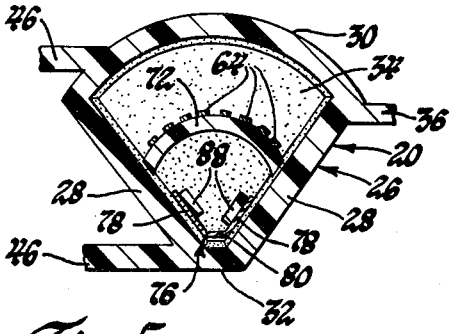
FIG. 5 is a sectional view taken generally along the plane indicated by line 5—5 of FIG. 3.

The body portion 62 and the contact fingers 64 of the contact assembly are received within recess 26, with the flanges 66 being located in partially overlying cantilevered relationship to the flange 38 and seating thereon as best shown in FIG. 3. The apertures 68 of the flanges 66 receive integral posts 70 of flange 38 in order to accurately locate the contact assembly within the recess. As best shown in FIGS. 3 through 5, the lower terminal ends of the contact fingers 64 slidably engage the distal side of an arcuate stop or rib 72 which is formed integral with wall 34 and the side walls 28 of the recess. As best shown in FIGS. 2, 3, and 6, a terminal plate 74 covers the flanges 66 of the contact assembly and is provided with pairs of openings which align with the openings of the flanges and are likewise received on the posts 70 of flange 38. Such posts, after assembly of the flanges 66 and plate 74 thereto, are heat deflected over the plate as shown in FIG. 2 to secure the contact assembly and the terminal plate 74 to the wall 38 and ensure an accurate location of the contact assembly with respect to the recess 26.

In order to ensure that the contact fingers 64 resiliently engage the rib 72, the flanges 66 can be formed at an obtuse angle, such as 100°, to the body portion 62 to ensure that the fingers are deflected when they engage the distal side of rib 72. Alternatively, the lower terminal portions of the contact fingers 64 can be slightly offset, such as 5° to 7°, to the remainder of the contact fingers to ensure such resilient engagement.

The terminal plate 74 provides for electrical connection of the contact assembly to a source of power and to a diagnostic circuit as will be further described but also has an additional important function. This plate is formed of thicker material than the contact assembly for electrical connection purposes. Additionally, as can be seen in FIG. 3, plate 74 prevents bending of the cantilevered flanges 66 upwardly with respect to flange 38 and the posts 70 to ensure that the body portion 62 and the contact finger 64 cannot move upwardly of recess 26 and disengage the contact fingers from the rib 72.

The sensor 14 also includes a monitor contact assembly 76, best shown in FIG. 6, which may be used if so desired. The monitor contact assembly 76 generally includes a pair of contact legs 78 which are partially joined by an integral web 80. The free portion of each leg is reinforced by an integral rib 82, and each leg is further provided with an apertured lateral flange 84. The monitor contact assembly 76 extends longitudinally within the recess 26, FIGS. 2 through 5, with the flanges 84 overlying the flange 38 and the apertures thereof receiving integral posts 86 of flange 38. Such posts are thereafter heat deflected over the flanges as shown in FIG. 2 in order to secure the monitor contact assembly to the flange 38. The flanges 84 are located at a slight acute angle to the legs 78 to ensure that these legs conform to the taper of the recess 26 and engage the angular side walls 28 of the recess adjacent the proximal wall 32 of the recess. The web 80 is slightly spaced from wall 32.

As best shown in FIGS. 3 and 5, the wall 34 of the recess is provided with a pair of upstanding lugs 88 in slightly spaced relationship to each of the walls 28 of the recess and receiving a respective leg 78 therebetween. These lugs are heat deflected toward a respective side wall of the recess in order to ensure a clamping relationship of the legs 78 against the walls 28 respectively of the recess.

One of the flanges 84 of the monitor contact assembly is provided with a slotted terminal flange 90. A diagnostic resistor 92 has one lead soldered to flange 90 and the other lead soldered to a lateral flange 94 of the plate 74. The resistor is part of a monitor circuit which checks the engagement of the mass with the legs 78 as will be described.

The hanger assembly 98 of sensor 14 includes a hanger plate 100 provided with an apertured deflectable tab or portion 102. A deflectable wire 104 has the upper laterally bent end 106 thereof overlying and soldered to the tab 102 with the free end of the wire being hooked at 108, FIG. 3, to the tab through the aperture thereof.

The flange 38 includes a pair of laterally or upwardly extending lugs or supports 110, each located generally adjacent the upper end of one side wall 28 of the recess, FIG. 6. The inner post is slotted for the lead of resistor 92 extending to flange 90. Each support is provided with an integral post 112 and a bore 114. The hanger plate 100 seats on the supports 110, with a pair of openings of the hanger plate receiving the posts 112 to accurately locate the hanger plate across the open end of the recess 26. Screws 116, FIGS. 2 and 6, extend through other openings of the hanger plate and into the bores 114 to further secure the hanger plate in place. The posts 112 are heat deflected over the hanger plate in the same manner as the posts 68 and 86 after assembly of the hanger plate to the supports 110.

As best shown in FIG. 3, the wire 104 is soldered to and supports the mass 118 within the recess 26. The tab 102 of the hanger plate is bent relative to the hanger plate to ensure that the wire 104 is deflected as shown in FIG. 3. The deflected wire biases the mass 118 into engagement with the legs 78 of the monitor contact assembly 76 under a predetermined force providing a preload bias on the mass resisting movement of the mass toward the distal wall of the recess and into engagement with the contact fingers 64. If the monitor contact assembly is not desired, then the mass will engage the angular side walls 28 of the recess adjacent the juncture thereof with the proximal wall 32.

From the foregoing description it can be seen that the sensor of this invention provides a housing including an integral elongated recess which is closed at one end by an integral wall and provided with an integral lateral flange or wall at its other open end which provides for both accurately locating and mounting a contact assembly and a hanger assembly thereon as well as a monitor contact assembly if one is desired.

When the object on which the sensor 14 is mounted is subjected to an acceleration pulse of predetermined amplitude and time sufficient to overcome the preload bias on the mass 118, the mass will thereupon move within the recess toward the distal wall 30 and into engagement with one or more of the contact fingers 64 to close a circuit across a source of power and a device to be actuated.

While the sensor of this invention is shown with the preload bias on the mass 118 being provided by the deflection of the wire 104, it should be noted that such preload bias can also be provided by a magnet as shown in Brooks et al U.S. Pat. No. 3,678,763, or by both deflection of the wire and a magnet. If a magnet is used, then the housing assembly 20 can be provided with an appropriately shaped integral recess, such as the recess 54 shown in Porter et al U.S. Pat. No. 3,717,731 in order to house and retain the magnet.

Figure 7:
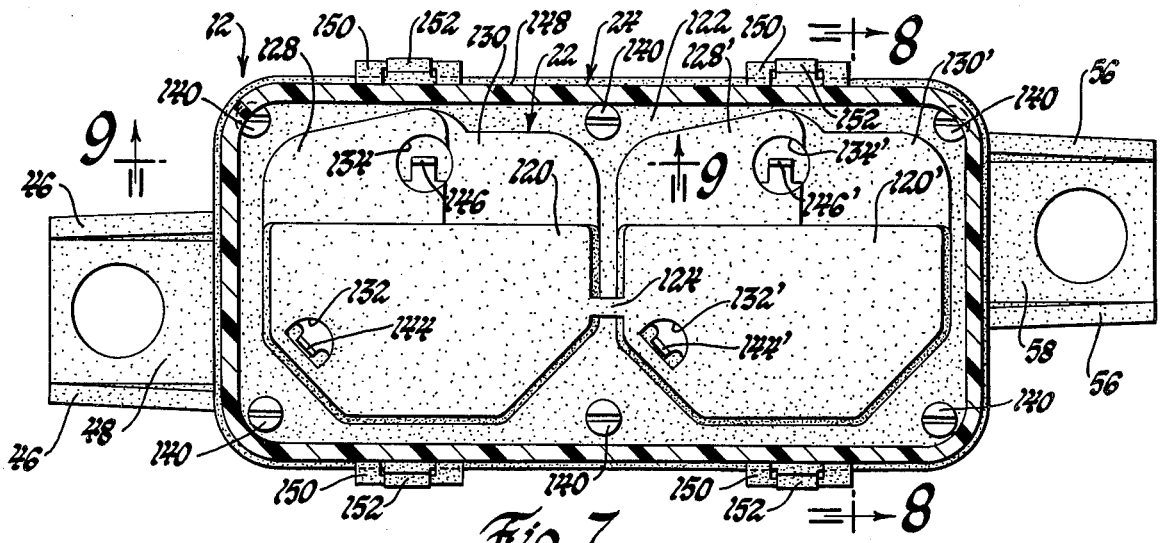
FIG. 7 is a view taken generally along the plane indicated by line 7—7 of FIG. 1.
Figure 8:
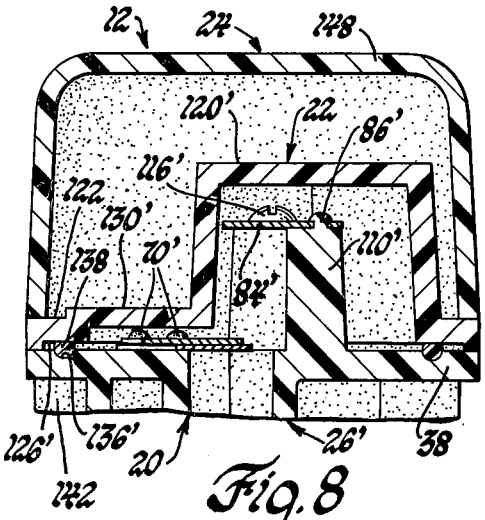
FIG. 8 is a sectional view taken generally along the plane indicated by line 8—8 of FIG. 7.
Figure 9:
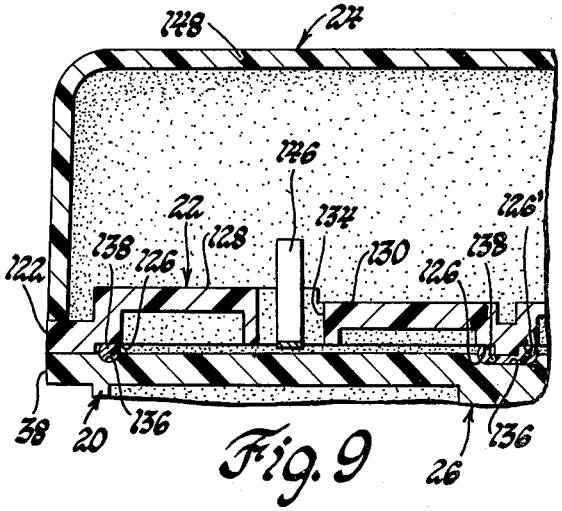
FIG. 9 is a sectional view taken generally along the plane indicated by line 9—9 of FIG. 7.

As best shown in FIGS. 1, 3 and 7, the cover assembly 22 includes a like pair of cap members 120, 120' which are integrally interconnected by a lateral flange 122 and a thin web 124. The flange 122 is upwardly offset at 126, 126' around each of the cap members and further upwardly offset at 128 and 130. The upper wall of each cap member is apertured at 132 and the offset 130 is apertured at 134.

The cover assembly seats on the flange 38 of the housing assembly 20 as shown in FIG. 1. As shown in FIGS. 2 and 6, the flange 38 is provided with a shallow groove 136 in its upper surface surrounding the posts 70 and 86, the support members 110, and the opening of the recess 26. A formed in place resilient gasket 138, FIG. 3, is received in this groove and engages the offset 126 of flange 122 of the cover assembly in order to seal the cover assembly to the housing assembly around each of the recesses. The cover assembly is secured to the housing assembly by a plurality of screws 140 which extend through openings in flange 122 and into integral bosses 142, FIGS. 1 and 3, of the housing assembly which depend from flange 38. The opening 132 receives a lateral terminal 144 of hanger plate 100 and the opening 134 receives a lateral terminal 146 of the plate 74, as best shown in FIGS. 1 and 3. The offset 128 accommodates flange 94 of plate 74 and the adjacent one pair of posts 70, while offset 130 accommodates the other pair of posts 70.

The dust cover assembly 24 includes a generally rectangular shaped cover 148 seating on the flange 122 of the cover assembly 22. The cover 148 is provided with four generally U-shaped depending ears 150 which snap over lugs 152 of the flange 122 in order to releasably secure the cover 148 to the cover assembly 22. As shown in FIG. 1, the dust cover assembly 24 is provided with an opening 154 in one of its end walls in order that a wiring harness can extend into the space between the dust cover assembly 24 and the cover assembly 22 for connection to the terminals 144 and 146 of each of the sensors.

Thus this invention provides an improved acceleration responsive sensor.

The embodiments of the invention in which an exclusive property or privilege is claimed are defined as follows:

1. A sensor, comprising, in combination, a housing of molded dielectric material having an elongated sector shaped recess defined by a pair of angularly related side walls integrally joined by distal and proximal walls, the housing including an integral end wall closing one end of the recess and an integral lateral wall surrounding the other open end of the recess, a contact assembly including a body portion and a plurality of deflectable contact fingers extending longitudinally through the recess, integral means on the lateral wall locating and mounting the body portion thereon, cooperating means on the contact fingers and housing locating the contact fingers in a predetermined deflected position relative to the proximal wall of the recess to provide a predetermined bias on the contact fingers resisting deflection thereof toward the distal wall of the recess, an acceleration responsive mass, support means supporting the mass within the recess in biased engagement with the angular side walls of the recess to locate the mass in predetermined spaced relationship to the contact fingers and provide a preload force resisting movement of the mass toward the distal wall of the recess, integral means on the lateral wall locating and mounting the support means thereon, an acceleration pulse of predetermined amplitude and time moving the mass against the preload force into engagement with the contact fingers to deflect the contact fingers against the predetermined bias toward the distal wall and close a circuit across a source of power connected to the mass and the contact fingers, the deflection of the contact fingers damping movement of the mass to minimize contact bounce, and cover means covering the open end of the recess.

2. A sensor, comprising, in combination, a housing of molded dielectric material having an elongated sector shaped recess defined by a pair of angularly related side walls integrally joined by distal and proximal walls, the housing including an integral end wall closing one end of the recess and an integral flange surrounding the other open end of the recess, a contact assembly including a body portion and a plurality of deflectable contact fingers extending longitudinally through the recess, integral means on the housing flange locating and mounting the body portion thereof, means on the end wall of the housing locating the contact fingers in a predetermined deflected position relative to the proximal wall of the recess to provide a predetermined bias on the contact fingers resisting deflection thereof toward the distal wall of the recess, an acceleration responsive mass, support means mounted on the housing flange and supporting the mass within the recess, means biasing the mass into engagement with the angular side walls of the recess to locate the mass in predetermined spaced relationship to the contact fingers and provide a preload force resisting movement of the mass toward the distal wall of the recess, an acceleration pulse of predetermined amplitude and time moving the mass against the preload force into engagement with the contact fingers to deflect the contact fingers against the predetermined bias toward the distal wall and close a circuit across a source of power connected to the mass and the contact fingers, the deflection of the contact fingers damping movement of the mass to minimize contact bounce, and cover means covering the open end of the recess, the integral mounting and locating means, and the support means.

3. A sensor, comprising, in combination, a housing of molded dielectric material havig an elongated sector shaped recess defined by a pair of angularly related side walls integrally joined by distal and proximal walls, the housing including an integral end wall closing one end of the recess and an integral lateral wall surrounding the other open end of the recess, a contact assembly including a body portion having a plurality of deflectable contact fingers extending longitudinally to adjacent the end wall of the recess and a plurality of flanges extending laterally therefrom and overlying the lateral wall of the housing, means on the end wall of the housing slidably engaged by the contact fingers to locate the contact fingers in a predetermined deflected position relative to the proximal wall of the recess and provide a predetermined bias on the contact fingers resisting deflection thereof toward the distal wall of the recess, means including integral means on the lateral wall locating and securing the flanges of the contact assembly to the lateral wall of the housing and blocking deflection of the flanges relative thereto to block sliding disengagement of the fingers and the means on the end wall of the housing, an acceleration responsive mass, support means mounted on the lateral wall of the housing supporting the mass within the recess, means biasing the mass into engagement with the angular side walls of the recess to locate the mass in predetermined spaced relationship to the contact fingers and provide a preload force resisting movement of the mass toward the distal wall of the recess, an acceleration pulse of predetermined amplitude and time moving the mass against the preload force into engagement with the contact fingers to deflect the contact fingers against the predetermined bias toward the distal wall and close a circuit across a source of power connected to the mass and the contact fingers, the deflection of the contact fingers damping movement of the mass to minimize contact bounce, and cover means covering the open end of the recess, the contact assembly securing means and the mass support means.

4. A sensor, comprising, in combination, a housing of molded dielectric material having an elongated sector shaped recess defined by a pair of angularly related side walls integrally joined by distal and proximal walls, the housing including an integral end wall closing one end of the recess and an integral lateral flange surrounding the other open end of the recess, a contact assembly having a body portion cantilevered within the recess by integral flanges thereof seated on the housing flanges and including a plurality of deflectable contact fingers extending longitudinally through the recess, integral means on the housing flange locating and mounting the body portion flanges thereon, cooperating means on the contact fingers and housing locating the contact fingers in a predetermined deflected position relative to the proximal wall of the recess to provide a predetermined bias resisting deflection thereof toward the distal wall of the recess, an integral support member extending laterally of the housing flange adjacent each side wall of the recess, an acceleration responsive mass, a hanger assembly including a support plate and a deflectable member extending therefrom and secured to the mass, cooperating means on the support members and support plate locating the plate outwardly of and across the open end of the recess with the deflectable member extending through the recess and being deflected by engagement of the mass with the angular side walls thereof to locate the mass in predetermined spaced relationship to the contact fingers and provide a preload force resisting movement of the mass toward the distal wall of the recess, an acceleration pulse of predetermined amplitude and time moving the mass against the preload force into engagement with the contact fingers to deflect the contact fingers against the predetermined bias toward the distal wall and close a circuit across a source of power connected to the mass and the contact fingers, the deflection of the contact fingers damping movement of the mass to minimize contact bounce, and a cover of molded dielectric material over the recess, the mounting means, and the support members and being secured to the housing flange.

5. A sensor, comprising, in combination, a housing of molded dielectric material having an elongated sector shaped recess defined by a pair of angularly related side walls integrally joined by distal and proximal walls, the housing including an integral end wall closing one end of the recess and an integral flange surrounding the other open end of the recess, and having first and second pairs of integral heat deflectable posts, a contact assembly including a body portion having a plurality of deflectable contact fingers extending therefrom through the recess and apertured flanges overlying the housing flange and received on the first pair of posts, the posts being heat deflected over the flanges to mount the body portion on the housing flange, cooperating means on the contact fingers and housing locating the contact fingers in predetermined spaced relationship to the proximal wall of the recess under a predetermined bias resisting deflection of the contact fingers toward the distal wall of the recess, an acceleration responsive mass, a hanger assembly including an apertured hanger member received on the second pair of posts, the posts being heat deflected over the member to mount the hanger assembly on the housing flange, the assembly including a resiliently deflectable portion on the housing flange, supporting the mass within the recess in biased engagement with the angular side walls of the recess to locate the mass in predetermined spaced relationship to the contact fingers and provide a preload force resisting movement of the mass toward the distal wall of the recess, an acceleration pulse of predetermined amplitude and time moving the mass against the preload force into engagement with the contact fingers to deflect the contact fingers against the predetermined bias toward the distal wall and close a circuit across a source of power connected to the mass and the contact fingers, the deflection of the contact fingers damping movement of the mass to minimize contact bounce, and a cover of molded dielectric material over the recess and the heat deflected posts and having integral flange means secured to the housing flange.

6. A sensor, comprising, in combination, a housing of molded dielectric material having an elongated sector shaped recess defined by a pair of angularly related side walls joined by distal and proximal walls, the housing including an integral end wall closing one end of the recess and an integral flange adjacent the other end of the recess, a generally semicircular integral rib on the end wall extending axially of the recess intermediate the angular side walls, a contact assembly including a mounting portion secured to the housing flange and a plurality of contact fingers extending through the recess into deflected slidable engagement with the distal side of the rib to locate the contact fingers in predetermined spaced relationship to the proximal wall of the recess under a predetermined bias resisting deflection of the fingers toward the distal wall of the recess, an acceleration responsive mass, and means supporting the mass within the recess in engagement with the angular side walls thereof and in predetermined spaced relationship to the contact fingers, an acceleration pulse of predetermined amplitude and time moving the mass into engagement with the contact fingers to deflect the contact fingers with respect to the rib and close a circuit across a source of power connected to the mass and the contact fingers, the deflection of the contact fingers with respect to the rib damping the movement of the mass to minimize contact bounce, and means covering the open end of the recess and secured to the housing flange.

* * * * *